US006576413B2

(12) United States Patent
Uytterhoeven et al.

(10) Patent No.: US 6,576,413 B2
(45) Date of Patent: Jun. 10, 2003

(54) PHOTOTHERMOGRAPHIC RECORDING MATERIAL WITH INCREASED PHOTOSENSITIVITY

(75) Inventors: Herman Uytterhoeven, Bonheiden (BE); Johan Loccufier, Zwijnaarde (BE); Yvan Gilliams, Hever (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/935,515

(22) Filed: Aug. 23, 2001

(65) Prior Publication Data

US 2002/0058217 A1 May 16, 2002

Related U.S. Application Data

(60) Provisional application No. 60/243,888, filed on Oct. 27, 2000.

(30) Foreign Application Priority Data

Sep. 11, 2000 (EP) ..... 00203139

(51) Int. Cl.[7] ..... G03C 1/498; G03C 1/09

(52) U.S. Cl. ..... 430/619; 601/603; 601/610; 601/620; 601/631; 601/964

(58) Field of Search ..... 430/619, 620, 430/631, 601, 603, 529, 964, 610

(56) References Cited

U.S. PATENT DOCUMENTS

| | | | |
|---|---|---|---|
| 1,623,499 | A | 4/1927 | Sheppard et al. |
| 4,897,343 | A | 1/1990 | Ikeda et al. |
| 5,714,311 | A | 2/1998 | Cowdery-Corvan et al. |
| 5,891,615 | A | 4/1999 | Winslow et al. |
| 5,965,346 | A | 10/1999 | Inagaki et al. |
| 6,083,680 | A | 7/2000 | Ito et al. |

FOREIGN PATENT DOCUMENTS

| | | | |
|---|---|---|---|
| EP | 0 594 050 | A1 | 4/1994 |
| EP | 0 880 061 | A1 | 11/1998 |
| EP | 0 911 692 | A2 | 4/1999 |
| EP | 0 962 812 | A1 | 12/1999 |
| JP | 7-333776 | | 12/1995 |

OTHER PUBLICATIONS

Thomas, Woodlief, Jr., *SPSE Handbook of Photographic Science and Engineering*, New York, Wiley Interscience, p. 422, (1973).

T. H. James *The Theory of the Photographic Process*, 4$^{th}$ Ed., New York, Macmillan Publishing Co., Inc., pp. 151–152 (1977).

Search Report for EP 00 20 3139 dated Jun. 25, 2001.

*Primary Examiner*—Thorl Chea

(74) *Attorney, Agent, or Firm*—Leydig, Voit & Mayer, Ltd.

(57) ABSTRACT

An aqueous dispersion comprising a binder or a surfactant, a substantially light-insensitive and substantially water-insoluble organic silver salt and a photosensitive silver halide, wherein the aqueous emulsion further comprises a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts; and production process for therefor and a photothermographic recording material comprising a support and a photo-addressable thermally developable element, the photo-addressable thermally developable element fulfilling two requirements: (i) the photo-addressable thermally developable element contains a substantially light-insensitive and substantially water-insoluble organic silver salt, a reducing agent for the substantially light-insensitive and substantially water-insoluble organic silver salt and in thermal working relationship therewith, a photosensitive silver halide and a binder; and (ii) the photo-addressable thermally developable element comprises a layer obtainable by coating the above-mentioned aqueous dispersion onto the support.

8 Claims, No Drawings

PHOTOTHERMOGRAPHIC RECORDING MATERIAL WITH INCREASED PHOTOSENSITIVITY

The application claims the benefit of U.S. Provisional Application No. 60/243,888 filed Oct. 27, 2000.

FIELD OF THE INVENTION

The present invention relates to an aqueous dispersion of a substantially light-insensitive organic silver salt and a photosensitive silver halide and a photothermographic recording material prepared therefrom.

BACKGROUND OF THE INVENTION

The SPSE Handbook of Photographic Science and Engineering, edited by Woodlief Thomas, Wiley-Interscience, New York (1973), page 422 states that compounds such as stannous salts, sodium hydrosulfite and silanes are capable of seducing silver halide in a grain.

The Theory of the Photographic Process Fourth Edition, edited by T. H. James, Eastman Kodak (1977), pages 151–152 discusses the reduction sensitization of silver halide emulsions. The chemicals studied therefor, according to James, include stannous chloride, hydrazine, ethanolamine and aminoiminomethane sulfinic acid. Furthermore, low pAg sensitization, also called silver digestion, with inert gelatin produces a form of reduction sensitization.

EP-A 911 692 discloses the possibility of reduction sensitization of silver halide for use in photothermographic recording materials and discloses therefor: ascorbic acid, thiourea dioxide, stannous chloride, aminoiminomethane sulfinic acid, hydrazine derivatives, boran compounds, silane compounds, and polyamine compounds. Furthermore, it discloses that reduction sensitization can be performed by ripening the emulsions while maintaining the pH of the emulsions at 7 or higher, or at pAg 8.3 or lower and also that reduction sensitization can be conducted by introducing a single addition portion of silver ions during grain formation.

EP-A 962 812 discloses the possibility of reduction sensitization of silver halide for use in photothermographic recording materials and discloses therefor: stannous chloride, aminoiminomethane sulfonic acid, hydrazine derivatives, borane compounds, silane compounds, polyamines, ascorbic acid and thiourea dioxide. Furthermore, it discloses that reduction sensitization can be performed by ripening the emulsions while maintaining the pH of the emulsions at 7 or more, or the pAg thereof at 8.3 or less and also that reduction sensitization can be conducted by introducing single addition portions of silver ions during grain formation.

U.S. Pat. No. 5,965,346 discloses the possibility of reduction sensitization of silver halide for use in photothermographic recording materials and discloses therefor: ascorbic acid, thiourea dioxide, stannous chloride, aminoiminomethane sulfinic acid, a hydrazine derivative, a borane compound, a silane compound and a polyamine compound. Furthermore, it discloses that reduction sensitization may be performed by ripening the grains while keeping the emulsion at a pH of 7 or more, or at a pAg of 8.3 or less and also that reduction sensitization may also be performed by introducing single addition part of silver ion during the formation of grains.

U.S. Pat. No. 6,083,680 discloses the possibility of reduction sensitization of silver halide for use in photothermographic recording materials and discloses therefor: stannous chloride, aminoiminomethane sulfonic acid, hydrazine derivatives, borane compounds, silane compounds, polyamines, ascorbic acid and thiourea dioxide. Furthermore, it discloses that reduction sensitization can be performed by ripening the emulsions while maintaining the pH of the emulsions at 7 or more, or the pAg thereof at 8.3 or less and also that reduction sensitization can be conducted by introducing single addition portions of silver ions during grain formation.

A principal problem in developing photothermographic recording materials is their lower photosensitivities than silver halide emulsions. The environmental benefits of dispensing with the wet development necessary for silver halide emulsions by switching to photothermographic recording materials are self-evident. Furthermore, there are significant environmental and economic benefits in coating photothermographic recording materials from aqueous media over solvent media e.g. strongly reduced solvent emissions, no danger of solvent vapour explosions, availability of plant etc. A means of boosting the photosensitivity of photo-addressable thermally developable elements coated from aqueous media is therefore desirable.

Aspects of the Invention

It is therefore an aspect of the invention to provide a means of increasing the photosensitivity of photothermographic recording materials coated from aqueous media.

It is therefore a further aspect of the invention to provide a photothermographic recording material with increased photosensitivity whose photo-addressable thermally developable element is coated from aqueous media.

It is therefore another aspect of the invention to provide an aqueous dispersion for use in providing a photothermographic recording material with increased photosensitivity whose photo-addressable thermally developable element is coated from aqueous media.

Further aspects and advantages of the invention will become apparent from the description hereinafter.

SUMMARY OF THE INVENTION

Reduction sensitization of silver halide is a well-known technique for increasing the sensitivity of silver halide emulsions and hence it would be expected by one skilled in the art, that reducing agents known from such techniques could be used for reduction sensitization of photothermographic emulsions in which silver halide is used as the photosensitive agent. However, it has been found that many of the well-known reduction sensitizers from silver halide emulsion technology give rise to prohibitive fogging and a prohibitive increase in the exposure S required to achieve an optical density of 1.0 above the fogging level, i.e. a prohibitive decrease in photosensitivity, when used in aqueous dispersions of substantially light-insensitive silver salt and a photosensitive silver halide. However, a limited group of reduction agents have been identified which do effect sensitization in such aqueous dispersions.

The above mentioned aspects are realized by an aqueous dispersion comprising a binder or a surfactant, a substantially light-insensitive and substantially water-insoluble organic silver salt and a photosensitive silver halide, wherein the aqueous emulsion further comprises a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts.

The above mentioned aspects are also realized by a process for producing an aqueous dispersion comprising the steps of: (i) preparing a dispersion of photosensitive silver halide in an aqueous medium; (ii) adding at least one sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts to the dispersion prepared in step (i); and (iii) adding a substantially light-insensitive and substantially water-insoluble organic silver salt.

The above-mentioned aspects are also further realized by a photothermographic recording material comprising a support and a photo-addressable thermally developable element, the photo-addressable thermally developable element fulfilling two requirements: (i) the photo-addressable thermally developable element contains a substantially light-insensitive and substantially water-insoluble organic silver salt, a reducing agent for the substantially light-insensitive and substantially water-insoluble organic silver salt and in thermal working relationship therewith, a photosensitive silver halide and a binder; and (ii) the photo-addressable thermally developable element comprises a layer obtainable by coating the above-mentioned aqueous dispersion onto the support.

The above-mentioned aspects are also realized by a process for preparing a photothermographic recording material having a photo-addressable thermally developable element, the photo-addressable thermally developable element containing a substantially light-insensitive and substantially water-insoluble organic silver salt, a reducing agent for the substantially light-insensitive and substantially water-insoluble organic silver salt and a binder, comprising the steps of: (i) using a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts to increase the sensitivity of an aqueous emulsion comprising the binder or a surfactant, the substantially light-insensitive and substantially water-insoluble organic silver salt and the photosensitive silver halide; and (ii) coating the emulsion of step (i) on the support.

Further preferred embodiments of the present invention are disclosed in the dependent claims. de

DETAILED DESCRIPTION OF THE INVENTION

Definitions

The term aqueous for the purposes of the present invention includes mixtures of water with up to 40%, preferably up to 20%, by volume of water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

Substantially light-insensitive means not intentionally light sensitive and resistant to darkening upon exposure.

Substantially water-insoluble means a solubility in water at 20° C. of less than 2 mg/L.

Water-soluble means a solubility in water at 20° C. of at least 2 mg/L.

S is defined as that exposure in $mJ/m^2$ at which the photothermographic recording material attained an optical density of 1.0 above Dmin. Thus the lower the value of S, the higher the photosensitivity of the photothermographic recording material.

The UAg of an aqueous liquid is defined in this specification as the potential difference between a 99.99% pure silver electrode in the aqueous liquid and a reference electrode consisting of a Ag/AgCl-electrode in 3M KCl solution at room temperature connected with the liquid via a salt bridge consisting of a 10% $KNO_3$ salt solution.

By the term "heat solvent" in this specification is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the substantially light-insensitive and substantially water-insoluble organic silver salt, at a temperature above 60° C.

By thermally developable under substantially water-free conditions as used is the present specification, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977, page 374.

Aqueous Dispersion

The present invention provides an aqueous dispersion comprising a binder or a surfactant, a substantially light-insensitive and substantially water-insoluble organic silver salt and a photosensitive silver halide, wherein the aqueous emulsion further comprises a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts. The binder or surfactant is necessary to keep the substantially light-insensitive and water insoluble organic silver salt and the photosensitive silver halide in suspension.

In a first embodiment of the aqueous dispersion according to the present invention, the aqueous dispersion further contains a water-soluble silver salt with a water-solubility greater than 0.1 g/L of water at 20° C. The water-solubility of the water-soluble silver salt mainly influences the preparation time of the aqueous dispersion, since the increase in photosensitivity is dependent upon ionic dissociation of the water-soluble silver salt in the aqueous medium. The water-solubility of the water-soluble silver salt is therefore preferably greater than 0.1 g/L of water at 20° C.

In a second embodiment of the aqueous dispersion, according to the present invention, the quantity of the water-soluble silver salt added is at least 1 mol % with respect to the quantity of the photosensitive silver halide.

In a third embodiment of the aqueous dispersion, according to the present invention, the quantity of the water-soluble silver salt added is at least 15 mol % with respect to the quantity of the photosensitive silver halide.

In a fourth embodiment of the aqueous dispersion, according to the present invention, the quantity of the water-soluble silver salt added is less than 80 mol % with respect to the quantity of the photosensitive silver halide.

In a fifth embodiment of the aqueous dispersion, according to the present invention, the particle size of the photosensitive silver halide is between 70 and 100 nm.

In a sixth embodiment of the aqueous dispersion, according to the present invention, the aqueous dispersion further contains a reducing agent for the substantially light-insensitive and substantially water-insoluble organic silver salt.

Preparation of Aqueous Dispersion

A process for producing an aqueous dispersion is provided comprising the steps of: (i) preparing a dispersion of photosensitive silver halide in an aqueous medium; (ii) adding at least one sensitization agent selected from the group consisting of: tin(II) bromide, aminoiminomethane sulfinic acid, water-soluble salts of $H_3PO_3$, water-soluble salts of $H_3PO_2$, water-water-soluble $SO_3^{2-}$ salts and water-soluble $HSO_3^-$ salts to the dispersion prepared in step (i); and (iii) adding a substantially light-insensitive and substantially water-insoluble organic silver salt.

In a first embodiment of the process for producing an aqueous dispersion, according to the present invention, the process further includes the addition of a water-soluble silver salt having a water-solubility greater than 0.1 g in 1 L of water at 20° C.

According to the process for producing an aqueous emulsion according to the present invention the second silver salt can be added as an aqueous solution, dissolved in a small quantity of water-miscible organic solvent or as a slurry in water, although in the latter case the particles of second silver salt must dissolve during the production of the aqueous emulsion.

Reduction Sensitization Agents

Reduction sensitization agents, according to the present invention, are selected from the group consisting of: tin(II) bromide, aminoiminomethane sulfinic acid, water-soluble salts of $H_3PO_3$ (phosphorous acid), water-soluble salts of $H_3PO_2$ (hypophosphorous acid), water-soluble $SO_3^{2-}$ salts and water-soluble $HSO_3^-$ salts. Preferred reduction sensitizers according to the present invention are:

| | | |
|---|---|---|
| RS01 | = | tin (II) bromide = $SnBr_2$; |
| RS02 | = | aminoiminomethane sulfinic acid = formamidine-sulfinic acid = thiourea dioxide = $(NH_2)_2C{=}SO_2$; |
| RS03 | = | ammonium sulfite = $(NH_4)_2SO_3$; |
| RS04 | = | lithium sulfite = $Li_2SO_3$; |
| RS05 | = | sodium sulfite = $Na_2SO_3$; |
| RS06 | = | potassium sulfite = $K_2SO_3$; |
| RS07 | = | ammonium bisulfite = $NH_4HSO_3$; |
| RS08 | = | lithium bisulfite = $LiHSO_3$; |
| RS09 | = | sodium bisulfite = $NaHSO_3$; |
| RS10 | = | potassium bisulfite = $KHSO_3$; |
| RS11 | = | ammonium phosphite = $(NH_4)_2HPO_3$; |
| RS12 | = | lithium phosphite = $Li_2HPO_3$; |
| RS13 | = | sodium phosphite = $Na_2HPO_3$; |
| RS14 | = | potassium phosphite = $K_2HPO_2$; |
| RS15 | = | ammonium hypophosphite = $(NH_4)H_2PO_2$; |
| RS16 | = | lithium hypophosphite = $LiH_2PO_2$; |
| RS17 | = | sodium hypophosphite = $NaH_2PO_2$; |
| RS18 | = | potassium hypophosphite = $NaH_2PO_2$. |

Water-soluble Silver Salt

Whereas in convention photographic emulsions addition of a water-soluble silver salt to a dispersion of photosensitive silver halide prior to coating produces a photographic material with a very high fogging level, it has been surprisingly found that the addition of a silver salt with a water-solubility greater than 0.1 g/L water to an aqueous dispersion of a substantially light-insensitive and substantially water-insoluble organic silver salt and a photosensitive silver halide generally produced an additional increase in photosensitivity of a photothermographic recording material comprising a photo-addressable thermally developable element comprising a layer produced by coating the aqueous dispersion onto a support, while having only a marginal effect on the background density of prints produced therewith.

In a seventh embodiment of the aqueous dispersion, according to the present invention, the water-soluble silver salt has a solubility of greater than 0.1 g/L of water at 20° C.

In an eighth embodiment of the aqueous dispersion, according to the present invention, the water-soluble silver salt has a solubility of greater than 1 g/L of water at 20° C.

Suitable water-soluble silver salts according to the present invention include silver nitrate, silver acetate, silver propionate, silver sulfate, silver butyrate, silver isobutyrate, silver benzoate, silver tartrate, silver salicylate, silver malonate, silver succinate and silver lactate, with water-soluble silver salts selected from the group consisting of silver nitrate, silver acetate, silver lactate and silver sulfate being preferred.

It is known in silver halide photography that addition of soluble silver salts to a dispersion of a silver halide produces an increase in UAg (decrease in pAg an increase in free silver ion concentration), which can result in partial reduction of the silver salts present, thereby producing metallic silver nuclei. Such metallic silver nuclei give rise to an increased fogging level in silver halide photographic materials. It is possible that an analogous effect is the basis for the sensitivity increase arising from the addition of water-soluble silver salt.

Substantially light-insensitive and substantially water-insoluble organic silver salts The substantially light-insensitive and substantially water-insoluble organic silver salt may be a silver salt of any organic acid including heterocyclic nitrogen compounds e.g. silver benzotriazolate or silver benzimidazolate.

In a ninth embodiment of the aqueous dispersion, according to the present invention, the substantially light-insensitive and substantially water-insoluble organic silver salt is a silver salt of an organic carboxylic acid having as its organic group: aryl, aralkyl, alkaryl or alkyl groups.

In a tenth embodiment of the aqueous dispersion, according to the present invention, the substantially light-insensitive and substantially water-insoluble organic silver salt is an aliphatic carboxylic acid known as a fatty acid, wherein the aliphatic carbon chain has at least 12 C-atoms e.g. silver laurate, silver palmitate, silver stearate, silver hydroxystearate, silver oleate, silver behenate and silver arichidate, which silver salts are also called "silver soaps". Other silver salts of an organic carboxylic acid as described in GB-P 1,439,478, e.g. silver benzoate, and silver salts of organic carboxylic acids described in Research Disclosure 17029, but excluding silver salts of organic carboxylic acids substituted with a heterocyclic thione group as disclosed in Research Disclosure 12542 and U.S. Pat. No. 3,785,830, may likewise be used to produce a thermally developable silver image. Combinations of the substantially light-insensitive and substantially water-insoluble organic silver salts may also be used in the present invention.

Aqueous dispersions of the substantially light-insensitive and substantially water-insoluble organic silver salts or mixtures thereof can be produced as described in U.S. Pat. No. 5,891,616 and EP-A 848286 and U.S. Pat. No. 3,839,049.

Organic Reducing Agents

Suitable organic reducing agents for the reduction of the substantially light-insensitive and substantially water-insoluble organic silver salt particles are organic compounds containing at least one active hydrogen atom linked to O, N or C, such as is the case with: aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered Organic Reducing Agents Suitable organic reducing agents for the reduction of the substantially light-insensitive and substantially water-insoluble organic silver salt particles are organic compounds containing at least one active hydrogen atom linked to O, N or C, such as is the case with: aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130

Binders For the Photo-addressable Thermally Developable Element

The film-forming binder for use in the aqueous dispersion and photo-addressable thermally developable element of the present invention may a water-dispersible or a water-soluble binder.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

Suitable water-dispersible binders are any water-insoluble polymers e.g. water-insoluble cellulose derivatives, polyurethanes, polyesters polycarbonates and polymers derived from α, β-ethylenically unsaturated compounds such as after-chlorinated polyvinyl chloride, partially hydrolyzed polyvinyl acetate, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof.

Preferred water-dispersible binders are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders are water-dispersible film-forming polymers with covalently bonded moieties with one or more acid groups.

It should be noted that there is no-clear cut transition between a polymer dispersion and a polymer solution in the case of very small polymer particles resulting in the smallest particles of the polymer being dissolved and those slightly larger being in dispersion.

Water-dispersible binders with crosslinkable groups, e.g. epoxy groups, aceto-acetoxy groups and crosslinkable double bonds are also preferred. Preferred water-dispersible binders for use in the photo-addressable thermally developable element of the present invention are polymer latexes as disclosed in WO 97/04355.

The above mentioned binders or mixtures thereof may be used in conjunction with waxes or "heat solvents" also called "thermal solvents" or "thermosolvents" improving the reaction speed of the redox-reaction at elevated temperature.

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive and substantially water-insoluble organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be chemically sensitized with a chemical sensitizing agent such as a compound containing sulphur, selenium, tellurium etc., or a compound containing gold, platinum, palladium, iron, ruthenium, rhodium or iridium etc. in addition to sensitization with specific reducing agents, according to the present invention. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

Spectral Sensitizer

The aqueous dispersion or photo-addressable thermally developable element of the photothermographic recording material, according to the present invention, may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

The aqueous dispersion and photo-addressable thermally developable element, according to the present invention, may further include a supersensitizer. Preferred supersensitizers are selected from the group of compounds consisting of: mercapto-compounds, disulfide-compounds; stilbene compounds, organoborate compounds and styryl compounds.

Toning Agents

In order to obtain a neutral black image tone in the higher densities and neutral grey in the lower densities, the aqueous dispersion or photo-addressable thermally developable element according to the present invention may contain one or more toning agents. The toning agents should be in thermal working relationship with the substantially light-insensitive and substantially water-insoluble organic silver salt and reducing agents therefor during thermal processing.

Stabilizers and Antifoggants

In order to obtain improved shelf-life and reduced fogging, stabilizers and antifoggants such as phenyl tribromomethyl sulphone, 4-methyl phthalic acid and 2-mercapto-4-heptyl-oxadiazole may be incorporated into the aqueous dispersion and photo-addressable thermally developable elements according to the present invention.

Photo-addressable Thermally Developable Element

According to the present invention, the photo-addressable thermally developable element, the photo-addressable thermally developable element fulfilling two requirements: (i) the photo-addressable thermally developable element contains a substantially light-insensitive and substantially water-insoluble organic silver salt, a reducing agent for the substantially light-insensitive and substantially water-insoluble organic silver salt in thermal working relationship therewith, a photosensitive silver halide and a binder; and (ii) the photo-addressable thermally developable element comprises a layer obtainable by coating an aqueous dispersion, according to the present invention.

These two requirements will overlap in that the aqueous dispersion contains a binder or a surfactant, a substantially light-insensitive and substantially water-insoluble organic silver salt, a photosensitive silver halide, a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts and optionally contains a water-soluble silver salt with a solubility in water at 20° C. greater than 0.1 g/L, a reducing agent for the substantially light-insensitive and substantially water-insoluble organic silver salt, a spectral sensitizer, a supersensitizer, one or more stabilizers and a binder.

The photo-addressable thermally developable element may comprise a single layer, i.e. produced with the aqueous dispersion according to the present invention, or may comprise more than one layer, one of which is produced with the aqueous dispersion and the others containing the other ingredients necessary for image formation e.g. a reducing agent for the substantially light-insensitive and substantially water-insoluble organic silver salt, a binder, a toning agent and one or more stabilizers. The reducing agent should be present in such a way that it is able to diffuse to the particles of the substantially light-insensitive and substantially water-insoluble organic silver salt so that reduction thereof can take place and the toning agent and one or more stabilizers should be able to interact with the substantially light-insensitive and substantially water-insoluble organic silver salt and the reducing agent therefor.

The photo-addressable thermally developable element may also be coated with a protective layer.

Support

The support for the photothermographic recording material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Antihalation Dyes

The photothermographic recording materials used in the present invention may also contain antihalation or acutance dyes which absorb light which has passed through the photosensitive thermally developable photographic material, thereby preventing its reflection. Such dyes may be incorporated into the photo-addressable thermally developable element or in any other layer of the photothermographic material of the present invention.

Antistatic Layer

In a preferred embodiment the photothermographic recording material of the present invention an antistatic layer is applied to an outermost layer.

Surfactants and Dispersants

Surfactants are surface active agents which are soluble compounds which reduce the interfacial tension between a liquid and a solid. The thermographic and photothermographic recording materials of the present invention may contain anionic, non-ionic or amphoteric surfactants. Suitable dispersants are natural polymeric substances, synthetic polymeric substances and finely divided powders, for example finely divided non-metallic inorganic powders such as silica.

Coating

The coating of any layer of the photothermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, U.S.A.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Photothermographic recording materials according to the present invention may be used for both the production of transparencies, for example in the medical diagnostic field in which black-imaged transparencies are widely used in inspection techniques operating with a light box, and reflection type prints, for example in the hard copy graphics field and in microfilm applications. For such applications the support will be transparent or opaque, i.e. having a white light reflecting aspect. Should a transparent base be used, the base may be colourless or coloured, e.g. with a blue colour for medical diagnostic applications.

The invention is described hereinafter by way of INVENTION EXAMPLES 1 to 18 and COMPARATIVE EXAMPLES 1 to 15 in which all percentages are percentages by weight unless otherwise specified and the following not yet specified ingredients were used:

Photo-addressable thermally developable element:

| | | |
|---|---|---|
| AgB | = | silver behenate |

Reducing agents for AgX which give no sensitization:

| | | |
|---|---|---|
| R01 | = | dimethylaminoborane = $(CH_3)_2NH.BH_3$; |
| R02 | = | iron(II) sulfate = $FeSO_4$; |
| R03 | = | 1-formyl,2-phenylhydrazine; |
| R04 | = | ascorbic acid; |
| R05 | = | ethanolamine = $HOC_2H_4NH_2$ |

Binders:

| | | |
|---|---|---|
| R16875 | = | type R16875, a phthaloyl gelatine from ROUSSELOT; |
| K7598 | = | Type 7598, a calcium-free gelatin from AGFA-GEVAERT GELATINEFABRIEK; |
| Surfactant Nr. 1 | = | MARLON ™ A-396, a sodium alkyl-phenylsulfonate from Hüls; |
| Surfactant Nr. 2 | = | ERKANTOL ™ BX, a sodium diisopropyl-naphthalenesulfonate from BAYER;. |
| Surfactant Nr. 3 | = | ULTRAVON ™ W, supplied as a 75–85% concentrate of a sodium arylsulfonate by CIBA-GEIGY; |
| LOWINOX 22IB46 | = | 2-propyl-bis(2-hydroxy-3,5-dimethylphenyl)methane from CHEM. WERKE LOWI; |
| SENSI 01 | = | 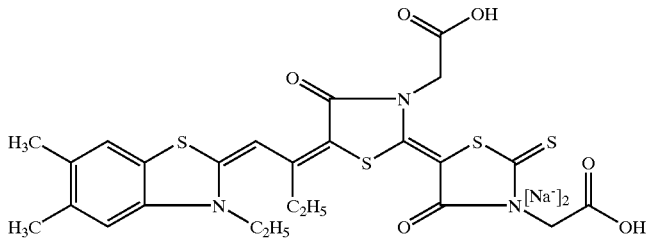 |
| TA01 | = | phthalazine; |

-continued

| | | |
|---|---|---|
| STABI 01 | = | 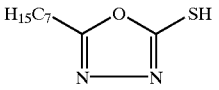 |
| STABI 02 | = | 4-methyl-phthalic acid; and |
| STABI 03 | = | phenyl tribromomethyl sulfone. |
| antihalation layer: | | |
| K7598 | = | Type 7598, a calcium-free gelatin from AGFA-GEVAERT GELATINEFABRIEK vorm. KOEPFF & SÖHNE; |
| KIESELSOL 300F | = | a 30% aqueous dispersion of colloidal silica from BAYER; and |
| LATEX 01 | = | a poly(ethyl acrylate) latex. |
| ANTIHALO 01 | | 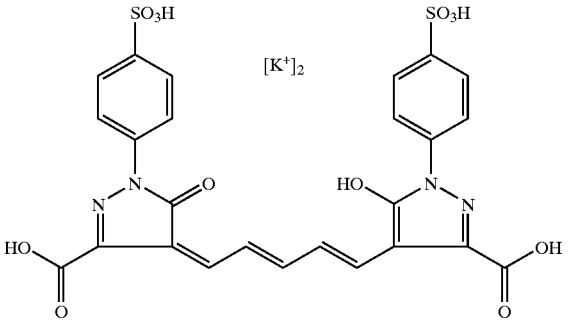 |
| protective layer: | | |
| K7598 | = | Type 7598, a calcium-free gelatin from AGFA-GEVAERT GELATINEFABRIEK vorm. KOEPFF & SÖHNE; |
| Surfactant Nr. 4 | = | ammonium salt of perfluoro-octanoic acid. |

INVENTION EXAMPLES 1 to 6

Comparative Examples 1 and 2

Preparation of silver behenate dispersions in an aqueous medium in the absence of organic solvent using a single jet process The aqueous dispersion of silver behenate used in INVENTION EXAMPLES 1 to 6 and COMPARATIVE EXAMPLES 1 and 2 was produced as follows:

i) dispersing 136.2 g (0.4M) behenic acid with stirring at 310 rpm with a 80 mm diameter typhoon stirrer in a 200 mm diameter vessel at 80° C. in a quantity of 549 mL of a 10% solution of Surfactant nr 1 and 662 g of deionized water at a temperature of 80° C.;

ii) then adding 188 mL of a 2M aqueous solution of sodium hydroxide with stirring at 310 rpm with a 80 mm diameter typhoon stirrer to the 200 mm diameter vessel at 80° C. over a period of 10 minutes to produce a clear solution substantially containing sodium behenate;

iii) then adding a 360 mL of a 1M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant 1 and was subsequently desalted using ultrafiltration and concentrated to an aqueous dispersion containing 22.37% by weight of silver behenate.

Preparation of Photosensitive Silver Halide

A silver halide emulsion consisting of 11.44% by weight of silver bromide with a weight average particle size of 73 nm as measured with the Moeller Teller method (see above for details)and 5.17% by weight of R16875 as dispersing agent in deionized water was prepared using-conventional silver halide preparation techniques at 50.5° C. such as described, for example, in T. H. James, "The Theory of the Photographic Process", Fourth Edition, Macmillan Publishing Co. Inc., New York (1977), Chapter 3, pages 88–104.

Preparation of Aqueous Dispersions 26.2 g of K7598 was dissolved in 150 g of deionized water at 40° C. To this gelatin solution 19.35 g of a 11.44% by weight dispersion of silver halide was then added over a period of 20 s with stirring corresponding to 11.7 mmol of silver halide. This silver halide was then reduction sensitized in situ by adding a 0.05% by weight solution of aminoiminomethane sulfinic acid (RS02) in the mol % quantities with respect to the silver halide given in Table 1 and heating with stirring at 40° C. for 30 minutes. Then the quantities of silver nitrate given in Table 1 were added as a 3.56% by weight solution and the resulting dispersion made up to 265.4 g with demineralized water while maintaining the temperature at 40° C. After stirring for 1 hour at 40° C. a UAg measurement was carried out (UAg-1) then 206.6 g of the above-described silver behenate dispersion was added together with 2.4 g of 1N nitric acid and after a further 20 minutes stirring at 40 a second UAg measurement (UAg-2) was carried out.

After the second UAg measurement the following ingredients were added: 8.7 g of a 4 g/L solution of SENSI 01 followed by 20 minutes stirring, then 11.8 g of a 8% by weight solution in methanol of STABI 01 and finally just before coating 112 g of a dispersion consisting of 4.68% by weight of phthalazine, 16.84% by weight of LOWINOX 22IB46 and 2% by weight of Surfactant Nr. 2.

TABLE 1

| Example nr | mmoles $AgNO_3$ added | mol $AgNO_3$/ mol AgX | $\mu$moles RS02 added | mmol RS02/ mol AgX | UAg-1 [mV] | UAg-2 [mV] |
|---|---|---|---|---|---|---|
| Comparative 1 | 0 | 0 | 0 | 0 | — | 299 |
| Invention 1 | 0 | 0 | 12.21 | 1.04 | — | 304 |
| Invention 2 | 0 | 0 | 18.31 | 1.57 | — | 299 |
| Invention 3 | 0 | 0 | 24.42 | 2.09 | — | 308 |
| Comparative 2 | 4.19 | 0.358 | 0 | 0 | — | 410 |
| Invention 4 | 4.19 | 0.358 | 22.24 | 1.90 | — | 417 |
| Invention 5[a] | 4.19 | 0.358 | 22.24 | 1.90 | — | 416 |
| Invention 6 | 4.19 | 0.358 | 24.42 | 2.09 | — | 414 |

[a]silver nitrate solution was added and then after 30 minutes stirring, the aminoiminomethane sulfinic acid solution

Preparation of the Photothermographic Recording Materials

A antihalation layer dispersion was prepared by dissolving 62.5 g of K7598 in 1 L of deionized water at 40° C. The following ingredients were then added to the resulting gelatin solution: 14.5 g of a 10% by weight aqueous solution of ANTIHALO 01, 8 g of a 10% by weight aqueous dispersion of LATEX 01, 42 g of a 20% by weight aqueous dispersion of KIESELSOL 300F and finally the pH was adjusted to 6 before coating to a wet-layer thickness of 45 $\mu$m on one side of a 100 $\mu$m poly(ethene terephthalate) support subbed on both sides and drying at 25° C. for 5 minutes.

A solution for the first layer of the thermosensitive element was then prepared by dissolving 42.5 g of K7598 in 1928.2 g of deionized water at 40° C. and then adding the following ingredients with stirring: 8.7 g of STABI 02, 179.1 g of a STABI 03-dispersion (consisting of 17.5% by weight of STABI 03, 10% by weight of K7598 and 1% by weight of Surfactant Nr. 1), 6 g of 1-phenyl-5-mercapto-tetrazole dissolved in 227.3 g of methanol and 17.4 g of a 10% solution of Surfactant Nr. 3.

The side of the support not coated with the antihalation layer was then coated with the solution for the first layer of the thermosensitive element to a wet layer thickness of 50 $\mu$m to produce after drying at 25° C. for 5 minutes the first layer of the thermosensitive element.

The first layer of the thermosensitive element was then overcoated with the above-described aqueous dispersion to a wet layer thickness of 100 $\mu$m to form after drying at 25° C. for 5 minutes the second layer of the thermosensitive element.

Finally the second layer of the thermosensitive element was overcoated with a solution of 57 g of K7598 in 2560 g of deionized water to which 78 g of a 5% by weight solution of Surfactant Nr. 4 had been added to a wet layer thickness of 50 $\mu$m to form after drying at 25° C. for 5 minutes a protective layer.

Evaluation of the Photothermographic Recording Materials

The photothermographic recording materials of INVENTIVE EXAMPLES 1 to 6 and COMPARATIVE EXAMPLES 1 and 2 were first exposed to a He—Ne laser (632.8 nm) through a grey scale wedge to vary the exposure of the film and then heated for 20 s at 100° C. to produce a wedge image. The print density variation in the wedge image was determined with a MACBETH TD903 densitometer with a visual filter giving the dependence of optical density upon exposure. The S-values, defined as the exposure in mJ/m$^2$ at which an optical density of 1.0 above Dmin was achieved, were determined from these optical density-exposure dependencies. The lower the value of exposure, S, required to obtain an optical density of 1.0 above Dmin, the higher the photosensitivity of the photothermographic material.

Photothermographic evaluation to determine the background density Dmin and the S-value was carried out on photothermographic recording materials stabilized by subjection to 7 days at 45° C. and 70% relative humidity. The results of this evaluation of the photothermographic recording materials of INVENTION EXAMPLES 1 to 6 and COMPARATIVE EXAMPLES 1 and 2 are summarized in Table 2 below.

TABLE 2

| Example nr | RS agent | Dmin | S [mJ/m$^2$] |
|---|---|---|---|
| Comparative 1 | — | 0.31 | 562 |
| Invention 1 | RS02 | 0.35 | 240 |
| Invention 2 | RS02 | 0.32 | 158 |
| Invention 3 | RS02 | 0.34 | 148 |
| Comparative 2 | — | 0.37 | 200 |
| Invention 4 | RS02 | 0.31 | 141 |
| Invention 5[a] | RS02 | 0.31 | 158 |
| Invention 6 | RS02 | 0.31 | 178 |

[a]silver nitrate solution was added and then after 30 minutes stirring, the aminoiminomethane sulfinic acid solution The printing performance of the photothermographic recording materials of INVENTION EXAMPLES 1 to 3 and COMPARATIVE EXAMPLE 1 showed that, in the absence of added water-soluble silver salt, reduction with aminoiminomethane sulfinic acid (RS02) produced considerably lower S-values i.e. considerably higher photosensitivity. The best performance was achieved with 1.57 mmol RS02/mol silver halide (INVENTION EXAMPLE 2).

The photothermographic printing performance of the photothermographic recording materials of INVENTION EXAMPLES 4 to 6 and COMPARATIVE EXAMPLE 2 showed that, in the presence of added water-soluble silver salt, reduction with aminoiminomethane sulfinic acid (RS02) produced significantly lower S-values i.e. significantly higher photosensitivity and also a significant reduction in Dmin from 0.37 to 0.31.

The benefit accruing from the use of both the addition of the water-soluble silver salt and reduction with aminoiminomethane sulfinic acid was to be seen in the decreased Dmin values attained, the S-values observed being comparable with those in the absence of added water-soluble silver salt.

INVENTION EXAMPLES 7 to 14

The photothermographic recording materials of INVENTION EXAMPLES 7 to 14 were prepared as described for INVENTION EXAMPLES 1 to 6 and COMPARATIVE EXAMPLES 1 and 2, except that a 0.1% by weight solution of tin(II) bromide (RS01) was added instead of a 0.5% by weight solution of RS02 (aminoiminomethane sulfinic acid) The preparation conditions for the photothermographic recording materials of INVENTION EXAMPLES 7 to 14 together with those for COMPARATIVE EXAMPLES 1 and 2 are summarized in Table 3 below.

TABLE 3

| Example nr | mmoles $AgNO_3$ added | mol $AgNO_3$/ mol AgX | μmoles RS01 added | mmol RS01/ mol AgX | UAg-1 [mV] | UAg-2 [mV] |
|---|---|---|---|---|---|---|
| Comparative 1 | 0 | 0 | 0 | 0 | — | 299 |
| Invention 7 | 0 | 0 | 3.59 | 0.31 | — | 296 |
| Invention 8 | 0 | 0 | 5.34 | 0.46 | — | 296 |
| Invention 9 | 0 | 0 | 7.18 | 0.61 | — | 295 |
| Invention 10 | 0 | 0 | 8.98 | 0.77 | — | 297 |
| Invention 11 | 0 | 0 | 10.68 | 0.91 | — | 296 |
| Comparative 2 | 4.19 | 0.358 | 0 | 0 | — | 410 |
| Invention 12 | 4.19 | 0.358 | 7.18 | 0.61 | — | 412 |
| Invention 13 | 4.19 | 0.358 | 10.68 | 0.91 | — | 413 |
| Invention 14 | 4.19 | 0.358 | 16.16 | 1.38 | — | 417 |

The photothermographic evaluation of the photothermographic recording materials of INVENTION EXAMPLES 7 to 14 was carried out as described the photothermographic recording materials of INVENTION EXAMPLES 1 to 2 and COMPARATIVE EXAMPLES 1 and 2. The results obtained together with those for the photothermographic recording materials of COMPARATIVE EXAMPLES 1 and 2 are summarized in Table 4 below.

TABLE 4

| Example nr | RS agent | Dmin | S [mJ/m$^2$] |
|---|---|---|---|
| Comparative 1 | — | 0.31 | 562 |
| Invention 7 | RS01 | 0.36 | 251 |
| Invention 8 | RS01 | 0.41 | 178 |
| Invention 9 | RS01 | 0.42 | 200 |
| Invention 10 | RS01 | 0.43 | 200 |
| Invention 11 | RS01 | 0.45 | 200 |
| Comparative 2 | — | 0.37 | 200 |
| Invention 12 | RS01 | 0.35 | 100 |
| Invention 13 | RS01 | 0.43 | 79 |
| Invention 14 | RS01 | 0.44 | 63 |

The photothermographic printing performance of the photothermographic recording materials of INVENTION EXAMPLES 7 to 11 and COMPARATIVE EXAMPLE 1 showed that, in the absence of added water-soluble silver salt, reduction with tin(II) bromide (RS01) produced considerably lower S-values i.e. considerably higher photosensitivity. The best performance was achieved with 0.46 mmol RS01/mol silver halide (INVENTION EXAMPLE 8).

The photothermographic printing performance of the photothermographic recording materials of INVENTION EXAMPLES 12 to 14 and COMPARATIVE EXAMPLE 2 showed that, in the presence of added water-soluble silver salt, reduction with tin(II) bromide (RS01) produced considerably lower S-values i.e. considerably higher photosensitivity and also Dmin values varying from slightly below the Dmin attained with the photothermographic recording material of COMPARATIVE EXAMPLE 2 (INVENTION EXAMPLE 12) to slightly above the Dmin value attained with the photothermographic recording material of COMPARATIVE EXAMPLE 2 (INVENTION EXAMPLES 13 and 14).

The benefit accruing from the use of both the addition of the water-soluble silver salt and reduction with tin(II) bromide (RS01) was to be seen in a further decrease in S-value i.e. a further increase in photosensitivity.

INVENTION EXAMPLES 15 to 18

The photothermographic recording materials of INVENTION EXAMPLES 15 to 18 were prepared as described for INVENTION EXAMPLES 1 to 6 and COMPARATIVE EXAMPLES 1 and 2, except that different reducing agents were added instead of tin(II) bromide in the quantities given in Table 2. The preparation conditions for the photothermographic recording materials of INVENTION EXAMPLES 15 to 18 are summarized together with those for COMPARATIVE EXAMPLES 1 and 2 in Table 5 below.

TABLE 5

| Example | mmoles | mol $AgNO_3$/ | reduction conditions | | | UAg-1 | UAg-2 |
|---|---|---|---|---|---|---|---|
| nr | $AgNO_3$ added | mol AgX | agent | μmoles added | mmol/mol AgX | [mV] | [mV] |
| Comparative 1 | 0 | 0 | — | — | — | — | 299 |
| Invention 15 | 0 | 0 | RS17 | 900 | 79 | 125 | 291 |
| Comparative 2 | 4.19 | 0.358 | — | — | — | — | 410 |
| Invention 16 | 4.19 | 0.358 | RS06 | 1100 | 95 | 431 | 411 |
| Invention 17 | 4.19 | 0.358 | RS13 | 22 | 1.88 | 437 | 419 |
| Invention 18 | 4.19 | 0.358 | RS17 | 900 | 79 | 439 | 414 |

The photothermographic evaluation of the photothermographic recording materials of INVENTION EXAMPLES 15 to 18 was carried out as described for the photothermographic recording materials of INVENTION EXAMPLES 1 to 2 and COMPARATIVE EXAMPLES 1 and 2. The results obtained together with those for the photothermographic recording materials of COMPARATIVE EXAMPLES 1 and 2 are summarized in Table 6 below.

TABLE 6

| Example nr | RS agent | Dmin | S [mJ/m$^2$] |
|---|---|---|---|
| Comparative 1 | — | 0.31 | 562 |
| Invention 15 | RS17 | 0.42 | 251 |
| Comparative 2 | — | 0.37 | 200 |
| Invention 16 | RS06 | 0.39 | 100 |
| Invention 17 | RS13 | 0.44 | 120 |
| Invention 18 | RS17 | 0.39 | 158 |

The photothermographic printing performance of the photothermographic recording materials of INVENTION EXAMPLE 15 and COMPARATIVE EXAMPLE 1 showed that, in the absence of added water-soluble silver salt, reduction with $NaH_2PO_2$ (RS17) produced a considerably lower S-value i.e. considerably higher photosensitivity.

The photothermographic printing performance of the photothermographic recording materials of INVENTION EXAMPLES 16 to 18 and COMPARATIVE EXAMPLE 2 showed that, in the presence of added water-soluble silver salt, reduction with potassium sulfite (RS06), $Na_2HPO_3$ (RS13) and $NaH_2PO_2$ (RS17) produced considerably lower S-values i.e. considerably higher photosensitivity COMPARATIVE EXAMPLES 3 to 15

The photothermographic recording materials of COMPARATIVE EXAMPLES 3 to 15 were prepared as described for INVENTION EXAMPLES 1 to 6 and COMPARATIVE EXAMPLES 1 and 2, except that different reducing agents, outside the scope of the present invention, were added instead of tin(II) bromide in the quantities given in Table 7. The preparation conditions for the photothermographic recording materials of COMPARATIVE EXAMPLES 3 to 15 with those for COMPARATIVE EXAMPLES 1 and 2 are summarized in Table 7 below.

TABLE 7

| Comparative example nr | mmoles $AgNO_3$ added | mol $AgNO_3$/ mol AgX | reducing agents outside the scope of the present invention agent | μmoles added | mmol/mol AgX | UAg-1 [mV] | UAg-2 [mV] |
|---|---|---|---|---|---|---|---|
| 1 | 0 | 0 | — | — | — | — | 299 |
| 3 | 0 | 0 | R01 | 1.44 | 0.12 | — | 280 |
| 4 | 0 | 0 | R01 | 7.2 | 0.62 | — | 281 |
| 5 | 0 | 0 | R02 | 22 | 1.9 | — | 299 |
| 6 | 0 | 0 | R02 | 29 | 2.5 | — | 294 |
| 7 | 0 | 0 | R02 | 37 | 3.2 | — | 300 |
| 8 | 0 | 0 | R03 | 11 | 0.95 | — | 293 |
| 9 | 0 | 0 | R03 | 55 | 4.7 | — | 294 |
| 10 | 0 | 0 | R04 | 100 | 9.5 | — | 273 |
| 11 | 0 | 0 | R04 | 1100 | 95 | — | 250 |
| 2 | 4.19 | 0.358 | — | — | — | — | 410 |
| 12 | 4.19 | 0.358 | R02 | 5600 | 0.47 | — | 398 |
| 13 | 4.19 | 0.358 | R04 | 5600 | 480 | — | 413 |
| 14 | 4.19 | 0.358 | R04 | 11000 | 950 | — | 406 |
| 15 | 4.19 | 0.358 | R05 | 14700 | 1260 | 340 | 378 |

The photothermographic evaluation of the photothermographic recording materials of COMPARATIVE EXAMPLES 3 to 15 were carried out as described for the photothermographic recording materials of INVENTION EXAMPLES 1 to 2 and COMPARATIVE EXAMPLES 1 and 2. The results obtained together with those for the photothermographic recording materials of COMPARATIVE EXAMPLES 1 and 2 are summarized in Table 8 below.

The photothermographic printing performance of the photothermographic recording materials of COMPARATIVE EXAMPLES 3 to 11 and COMPARATIVE EXAMPLE 1 showed that, in the absence of added water-soluble silver salt, treatment with the reducing agents: dimethylaminoborane (R01), iron(II) sulfate (R02), 1-formyl,2-phenylhydrazine (R03) and ascorbic acid (R04) produced a considerably higher S-value i.e. considerably lower photosensitivity together with increased Dmin values. This is surprising in that these reducing agents have been reported to be efficient reduction sensitizing agents for silver halide in silver halide emulsions.

TABLE 8

| Comparative example nr | Reducing agent | Dmin | S [mJ/m$^2$] |
|---|---|---|---|
| 1 | — | 0.31 | 562 |
| 3 | R01 | 1.7 | >1000 |
| 4 | R01 | 2.85 | >1000 |
| 5 | R02 | 0.4 | >1000 |
| 6 | R02 | 0.44 | >1000 |
| 7 | R02 | 0.48 | >1000 |
| 8 | R03 | 0.38 | >1000 |
| 9 | R03 | 0.36 | >1000 |
| 10 | R04 | 0.52 | >1000 |
| 11 | R04 | 1.33 | >1000 |
| 2 | — | 0.37 | 200 |
| 12 | R02 | 2.44 | >1000 |
| 13 | R04 | 3.36 | >1000 |
| 14 | R04 | 3.53 | >1000 |
| 15 | R05 | 0.86 | 79 |

The photothermographic printing performance of the photographic recording materials of COMPARATIVE EXAMPLES 12 to 15 and COMPARATIVE EXAMPLE 2 showed that, in the presence of added water-soluble silver salt, treatment with the reducing agents: iron (II) sulfate (R02), ascorbic acid (R04) and ethanolamine (R05) produced considerably higher S-values, with the exception of ethanolamine (R05), and prohibitively high Dmin values. This is surprising in that these reducing agents have been reported to be efficient reduction sensitizing agents for silver halide in silver halide emulsions.

Having described in detail preferred embodiments of the current invention, it will now be apparent to those skilled in the art that numerous modifications can be made therein without departing from the scope of the invention as defined in the following claims.

We claim:

1. An aqueous dispersion comprising a binder or a surfactant, a substantially light-insensitive and substantially water-insoluble organic silver salt, a photosensitive silver halide and a water-soluble silver salt with a water-solubility greater than 0.1 g/L of water at 20° C., wherein said aqueous emulsion further comprises a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts.

2. Aqueous dispersion according to claim 1, wherein said water-soluble silver salt is present in a concentration of at least 1 mol % with respect to said photosensitive silver halide.

3. Aqueous dispersion according claim 1, wherein said aqueous dispersion further contains a reducing agent for said substantially light-insensitive and substantially water-insoluble organic silver salt.

4. Aqueous dispersion according to claim 1, wherein said substantially light-insensitive and substantially water-insoluble organic silver salt is a silver salt of an organic carboxylic acid.

5. Aqueous dispersion according to claim 1, wherein said water-soluble silver salt is selected from the group consisting of silver nitrate, silver acetate, silver lactate and silver sulfate.

6. A process for producing an aqueous dispersion comprising the steps of: (i) preparing a dispersion of photosensitive silver halide in an aqueous medium; (ii) adding at least one sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts to the dispersion prepared in step (i); (iii) adding a substantially light-insensitive and substantially water-insoluble organic silver salt; and (iv) adding a water-soluble silver salt with a water-solubility greater than 0.1 g/L of water at 20° C.

7. A photothermographic recording material comprising a support and a photo-addressable thermally developable element, said photo-addressable thermally developable element fulfilling two requirements:

(i) said photo-addressable thermally developable element contains a substantially light-insensitive and substantially water-insoluble organic silver salt, a reducing agent for the substantially light-insensitive and substantially water-insoluble organic silver salt and in thermal working relationship therewith, a photosensitive silver halide, a water-soluble silver salt with a water-solubility greater than 0.1 g/L of water at 20° C., and a binder; and (ii) said photo-addressable thermally developable element comprises a layer obtainable by coating on a support an aqueous dispersion comprising a binder or a surfactant, a substantially light-insensitive and substantially water-insoluble organic silver salt and a photosensitive silver halide, wherein said aqueous emulsion further comprises a sensitization agent selected from the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts.

8. A process for preparing a photothermographic recording material having a photo-addressable thermally developable element, the photo-addressable thermally developable element containing a substantially light-insensitive and substantially water-insoluble organic silver salt, a reducing agent for said substantially light-insensitive and substantially water-insoluble organic silver salt and a binder, comprising the steps of: (i) using a sensitization agent selected form the group consisting of: tin(II) bromide, aminoiminomethane sulfinic acid, water-soluble salts of $H_3PO_3$, water-soluble salts of $H_3PO_2$, water-soluble $SO_3^{2-}$ salts and water-soluble $HSO_3^-$ salts to increase the sensitivity of an aqueous emulsion comprising said binder or a surfactant and a water-soluble silver salt with a water-solubility greater than 0.1 g/L of water at 20° C., said substantially light-insensitive and substantially water-insoluble organic silver salt and said photosensitive silver halide; and (ii) coating the emulsion of step (i) on a support.

* * * * *